US005846022A

United States Patent [19]

Grundl

[11] Patent Number: 5,846,022

[45] Date of Patent: Dec. 8, 1998

[54] APPARATUS FOR LAYING PAVEMENT LAYERS

[75] Inventor: Roland Grundl, Heiligkreuzsteinach, Germany

[73] Assignee: Joseph Vögele AG, Mannheim, Germany

[21] Appl. No.: 762,006

[22] Filed: Dec. 11, 1996

[30] Foreign Application Priority Data

Dec. 12, 1995 [DE] Germany ..... 295 19 719 U

[51] Int. Cl.[6] ..... E01C 19/00

[52] U.S. Cl. ..... 404/101; 404/108; 414/528

[58] Field of Search ..... 404/80, 81, 82, 404/101, 108, 110, 118; 414/528

[56] References Cited

U.S. PATENT DOCUMENTS

| | | | |
|---|---|---|---|
| 4,818,139 | 4/1989 | Brock et al. | 404/108 X |
| 5,035,534 | 7/1991 | Brock et al. | 404/81 |
| 5,100,277 | 3/1992 | Musil | 404/108 X |
| 5,269,626 | 12/1993 | Soliman et al. | 404/110 X |

FOREIGN PATENT DOCUMENTS

| | | |
|---|---|---|
| 26 28 325 | 1/1978 | Germany . |
| 43 42 997 | 6/1995 | Germany . |

*Primary Examiner*—James Lisehora
*Attorney, Agent, or Firm*—Finnegan, Henderson, Farabow, Garrett & Dunner, L.L.P.

[57] ABSTRACT

In an apparatus (G) for laying road pavement layers composed of first and second pavement material grades, there are provided at least one road finisher (F', F1, F2) comprising a material hopper, and a feeder (B) arranged upstream thereof and including a bulk material hopper (2) for the first pavement material grade (A) as well as a longitudinal conveying means (3, 4), wherein in the apparatus (G) the sole road finisher (F') comprises a second material hopper (29) for the second pavement material grade (B1) or a second road finisher comprising a material hopper (29') for the second pavement material grade (B1) is provided behind a first road finisher (F1), and the feeder (B) comprises a superstructure (6) extending above the bulk material hopper (2) and the first longitudinal conveying device (3, 4) and including a second longitudinal conveying and intermediate storage device (7, 10, 14) which extends either up to and over the second material hopper (29) of the sole road finisher (F') or the material hopper (29') of the rear road finisher (F2), a section (7) of the second longitudinal conveying and intermediate storage device being adjustable relative to the bulk material hopper (2) between a material receiving position and a passive position in which the bulk material hopper (2) is accessible to receive material.

14 Claims, 1 Drawing Sheet

G
30
31
33
F2
B1
14'
29'
26
28
32
14
27
F1
25
24
12
13
A
11
10
9
15
15a
5
21
4
1
17
16
3
22
6
B
18
20
7
2
23
8
19

G
30
31
26
27
33
F'
B1
32
12
29
11
24
9
A
5
17
4
1
B
2
7
8

APPARATUS FOR LAYING PAVEMENT LAYERS

The present invention relates to an apparatus for laying road-surface layers and a feeder for the material hopper of a road finisher.

Such apparatuses are used when two-layered roadway pavements are made. For instance, with a two-layered placement of "hot-on-hot" bituminous roadway surfaces, either one layer each must be laid with the aid of two road finishers directly one after the other, or use must be made of a special road finisher for laying the two layers in overlapping fashion. It is known from DE-43 42 997 A1 that a two-layered roadway pavement is made with the aid of a special road finisher that comprises first and second material hoppers, first and second distributing means, and first and second paving screeds, provided in-line, respectively. In practice, a device is known which comprises two directly successively operating road finishers of which each places one layer.

In both cases the apparatus comprising the special road finisher or the two road finishers is equipped with a feeder, a self-traveling paving material transfer vehicle, e.g. according to DE 26 28 325 A1, which takes over a pavement material grade from a truck and fills it into the material hopper of the road finisher so that the latter is able to work uninterruptedly. Since the feeder can only handle one pavement material grade, a second feeder would be required for the second pavement material grade for two-layered paving. From a technical point of view it does not make sense to alternately process two pavement material grades with one feeder.

It is the object of the present invention to provide an apparatus of the above-mentioned type as well as a feeder for exploiting the advantage of supplying the road finisher(s) of the apparatus by the feeder in a constructionally simple manner in the case of the two-layered laying of road surfaces.

This object is achieved in accordance with the present invention by providing an apparatus (G) for laying road-surface layers composed of first and second grades (A, B1) of pavement materials, comprising at least one road finisher (F, F1) which is provided at the front side with at least one material hopper for the first grade (A), and a feeder (B) which is provided in the traveling working direction upstream of said road finisher (F, F1) and which comprises a movable substructure, a bulk material hopper (2) located on said substructure for said first pavement material grade (A) and a longitudinal conveying device (3, 4) extending from said bulk material hopper up to and over the material hopper of said road finisher, characterized in that in said apparatus (G) the sole road finisher (F') comprises a second material hopper (29) for the second pavement material grade (B1) or that a second road finisher (F2) which comprises a material (29) for said second pavement material grade (B1) is provided behind a first road finisher (F1), that a superstructure (6) which extends above the bulk material hopper (2) and the first longitudinal conveying device (3, 4) is provided with a second longitudinal conveying and intermediate storage device (7, 10, 14) on said feeder (B) for feeding either the second material hopper (29) or the single road finisher (F') or the material hopper (29') of the rear and second road finisher (F2), that the second longitudinal conveying and intermediate storage device (7, 10, 14) extends either up to and over the second material hopper (29) of the single road finisher (F') or up to and over the material hopper (29') of the rear road finisher (F2), and that at least one (29') forward section (7) of the second longitudinal conveying and intermediate storage device (7, 10, 14) is adjustable on said feeder (B) relative to the bulk material hopper (2) between a material receiving position and a passive position in which the bulk material (2) of said feeder (B) is accessible to receive material.

The object is also achieved by providing a feeder (B) for the material hopper of at least one road finisher (F', F1, F2) comprising a self-propelled substructure having arranged thereon at the front end a bulk material hopper (2) for pavement material of a first grade (A), from which at least one first longitudinal conveying apparatus (3, 4) extends rearwards up to a first discharge portion, characterized in that said feeder (B) for feeding either a second material hopper (29) of a single road finisher (F') comprising two material hoppers or a material hopper (29') of a second rear road finisher (F2) provided behind a first road finisher (F1) has provided thereon a superstructure (6) extending above said bulk material hopper (2) and said first longitudinal conveying device (3, 4), said superstructure comprising at least a second longitudinal conveying and intermediate storage device (7, 10, 14) for said second pavement material grade (B1), that said second longitudinal conveying and intermediate storage device (7, 10, 14) extends either up to the second material hopper (29) of said single road finisher (F') or to the material hopper (29') of said rear and second road finisher (F2), and that at least one forward section (7) of said second longitudinal conveying and intermediate storage device (7, 10, 14) is adjustably supported on said feeder (B) relative to said bulk material hopper (29) between a material receiving position and a passive position in which said bulk material hopper (2) of said feeder is accessible to receive material.

In such an apparatus one and the same feeder alternately feeds first and second pavement material grades to the road finisher including the two material hoppers or the two road finishers having one respective material hopper. No second feeder is required for such a purpose. The road finishers comprising the two material hoppers, or the two road finishers, can operate in a continuous manner because despite the intermittent supply of the two pavement material grades by the feeders a supply as is required for continuous laying is guaranteed. The one pavement material grade is filled into the bulk material hopper of the feeder. By contrast the other pavement material grade is taken over by the second longitudinal conveying and intermediate storage device on the feeder, which device is supported on the first finisher. Despite the intermittent supply of the pavement material grades a sufficient supply of the road finisher or road finishers is guaranteed at any time despite the intermittent supply of the pavement material grades.

The feeder as a universal feeder combines the receiving and conveying capacity for two pavement material grades, and no impairment whatsoever has to be feared at the discharge side. As soon as the bulk material hopper, which is arranged on the substructure, must be filled, the forward section of the second longitudinal conveying and intermediate storage device is adjusted relative to the bulk material hopper in the passive position in which the bulk material hopper is accessible to receive material. As soon as the bulk material hopper has been filled, the forward section of the second longitudinal conveying and intermediate storage device can be moved into its material receiving position in which the second pavement material grade can be filled. It is here possible that the trucks which supply the respective pavement material grade directly approach the feeder or that the feeder moves away from the road finisher traveling behind the feeder at the traveling working speed so as to receive the respective pavement material grade and that the feeder fetches the respective pavement material grade.

An embodiment in which the further longitudinal section of the second longitudinal conveying and intermediate storage device is supported on the first road finisher is expedient, the support means being e.g. firmly provided on the front road finisher.

Another embodiment is advantageous in which the forward section has a stable pivotal support on the superstructure, the respective pivotal drive being supportable with the aid of the adjusting forces on the superstructure or the substructure.

Another embodiment is distinguished by the features that the forward section comprising the ground running wheels can at least be supported when the second pavement material grade is being filled in. The feeding trough ensures a sufficient capacity for the second pavement material grade, the feeding charge of which is advantageously distributed and intermediately stored along the second longitudinal conveying and intermediate storage device.

A belt conveyor which is provided on the feeder can perform an intermediate storing operation on the one hand and can transport the second pavement material grade rearwards on the other hand before it is directly discharged into the second material hopper of the single finisher or to the material hopper of the rear road finisher.

Since the belt conveyor has an intermediate storage function and since the pavement material is to be prevented from inexpediently cooling, a heating device is expedient in this area.

The belt conveyor or the slat conveyor expediently bridges the distance from the center belt conveyor to the rear road finisher or, optionally, to the second hopper of the single road finisher. The throw-off chute permits an environmentally beneficial delivery of the second pavement material grade.

In a further embodiment the feeder can be operated without any difficulties.

Of particular advantage is a further embodiment in which a feeder which is relatively heavy and has a relatively large constructional length can easily be handled with its carriage parts intended for working travel, namely for an automotive transportation, loading and unloading on and from a low loader and for maneuvering when the respective pavement material is being fetched. A considerably increased maneuverability of the feeder can be achieved by means of the lowerable steering wheels which lift the steerable working carriage part from the ground in the empty state of the feeder, and loading and unloading operations which are necessary in a low loader with auxiliary ramps can be simplified. The reason therefor is that an advantageous angle of action can be set by means of the steerable transport wheels for the working carriage part during an upward or downward rolling motion over the ramps when the front part of the feeder is lifted by means of the lowerable steerable transport wheels.

The feeder which has optionally been constructed according to a modular design system can also be retrofitted for the supply of only one conventional road finisher with one pavement material grade only, since the superstructure including the longitudinal conveying or intermediate storage device, or only the longitudinal conveying and intermediate storage device, can be mounted on the feeder in case of need, i.e. for a second pavement material grade. Furthermore, the structural unit can optionally be removed for transporting the feeder on a transportation vehicle so as to reduce the transportation height. The rearmost belt conveyor can be removed for a road finisher having two material hoppers. The whole structural unit can be removed for supplying a standard road finisher with material.

It is expedient to equip the feeder with a drive unit which is separated from the drive unit of the structural unit. The drive unit of the structural unit, for example, drives the components for conveying the second pavement material grade and is a supply device for the heating means. The drive units may be easily removable power packs.

Embodiments of the subject matter of the invention shall now be explained with reference to the drawing, in which.

Figure 1:
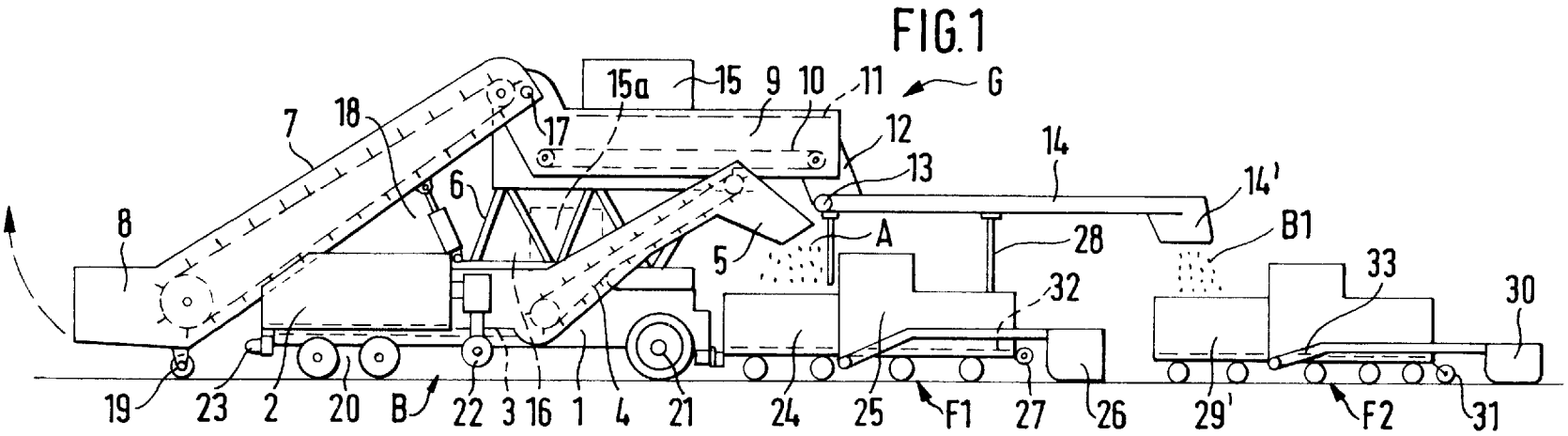
FIG. 1 is a diagrammatic side view of a first embodiment of an apparatus.

An apparatus (G) (a complete paving system) for making two-layered road surfaces, e.g. two-layered road surfaces composed of two grades A, B of bituminous pavement materials or of other materials, such as concrete paving material, consists according to FIG. 1 of a feeder B (a self-propelled feeder B) which is leading the system in the traveling working direction from the right to the left, a first road finisher F1 which lays grade A of the pavement material, and a second road finisher F2 which follows the first finisher and processes a second pavement material grade B1. Feeder B has a substructure 1 optionally provided with a drive unit 15*a* of its own, a steerable working carriage part 20 at the front and a driven carriage part 21 at the rear, as well as a front-bulk material hopper 2. A lower longitudinal conveying device 3 (belt conveyor or slat conveyor) extends from bulk material hopper 2 to a central slope conveyor 4 which has a discharge device 5 provided at the rear upper end. A superstructure 6 is mounted on substructure 1, e.g. in the manner of a framework, for a second longitudinal conveying and intermediate storage device. At 17 a front section 7 of the second longitudinal conveying and intermediate storage device is supported on superstructure 6 or on a horizontal conveyor channel 9 in an upwardly pivotable manner. A feeder trough 8 is provided at the front end of the forward section 7, which is designed as a slope conveyor. Expediently pivotable ground running wheels 19 are provided in this region. A horizontal belt conveyor or a slat conveyor 10 as well as heating devices 11 are contained in the longitudinal conveyor channel 9. The longitudinal conveyor channel 9 is expediently covered at the top. A rear belt conveyor or a slat conveyor 14 which is provided at the end with a throw-off chute 14' is pivotably mounted on a discharge device 12 of the longitudinal conveyor channel 9. This rear section (14) may be fixedly or pivotably (upwardly pivotably and/or laterally pivotably) mounted at a mounting point 13 and is supported with the aid of support means 28 on the first road finisher F1. The support means 28 are expediently mounted on the first road finisher F1. They may, however, also form part of the rear section (14). Another drive unit 15 is e.g. arranged above the horizontal conveyor channel 9. An operating platform 16 or an operator's stand is located laterally at the substructure 1. The front section 7 is supported via a lifting mechanism, such as a hydraulic cylinder 18, on the substructure 1 or on the superstructure 6, and can be pivoted upwards around pivot axis 17 from the receiving position shown in FIG. 1 into a passive position (illustrated in broken line) in which the bulk material hopper 2 is freely accessible to be directly filled. The arrangement of one single drive unit 15 on feeder B is possible.

Steerable transport wheels 22 which can be lowered from the illustrated passive position (for the working travel of feeder B) to such an extent that the carriage part 20 is lifted are arranged in lowerable fashion on substructure 1 between the carriage parts 20 and 21. The turning circle diameter for maneuvering feeder B in the lowered state of transport wheels 22 is considerably smaller than the turning circle diameter with carriage part 20. Furthermore, a conventional push-off device 23 on which a leading truck is supported when bulk material hopper 2 is being filled is provided on substrate 1 in front of and below bulk material hopper 2.

The first road finisher F1 has a forward material hopper 24 from which a conveying path 32 extends up to and in front of a rearward transverse distributing device 27, i.e. a distributing auger. Furthermore, the first road finisher F1 has a drive unit 25 having positioned therebehind a driver's cab and a trailing paving screed 26 (e.g. a high-compaction screed). The second road finisher F2 is also provided with a forward material hopper 29', a conveyor device 33 extending up to the transverse distributing device 31, and a trailing paving screed 30 (such as a high-compaction screed).

During operation of apparatus G two road finishers F1 and F2 move at a traveling working speed from the right to the left. The first road finisher F1 lays the first pavement material grade A as received by it from the bulk material hopper 2 of feeder B. The trailing second road finisher F2 lays the second pavement material grade B1 which is filled into its material hopper 29' via the second longitudinal conveying and intermediate storage device 7, 10, 14 of feeder B. The bulk material hopper 2 and the feeding trough 8 of feeder B are alternately filled, with feeder B traveling either permanently upstream of the first road finisher F1 at the traveling working speed or moving away from the two road finishers F1, F2 to be filled with the respective pavement material grade (A, B1), taking over the respective pavement material and then returning into the indicated position in front of the first finisher F1.

The second longitudinal conveying and intermediate storage device 7, 10, 14, either as such or together with superstructure 6, can constitute a structural unit of its own that is removable from and again attachable to feeder B, if necessary. Without the second longitudinal conveying and intermediate storage device, feeder B can be used for conventional monolayered paving.

Figure 2:
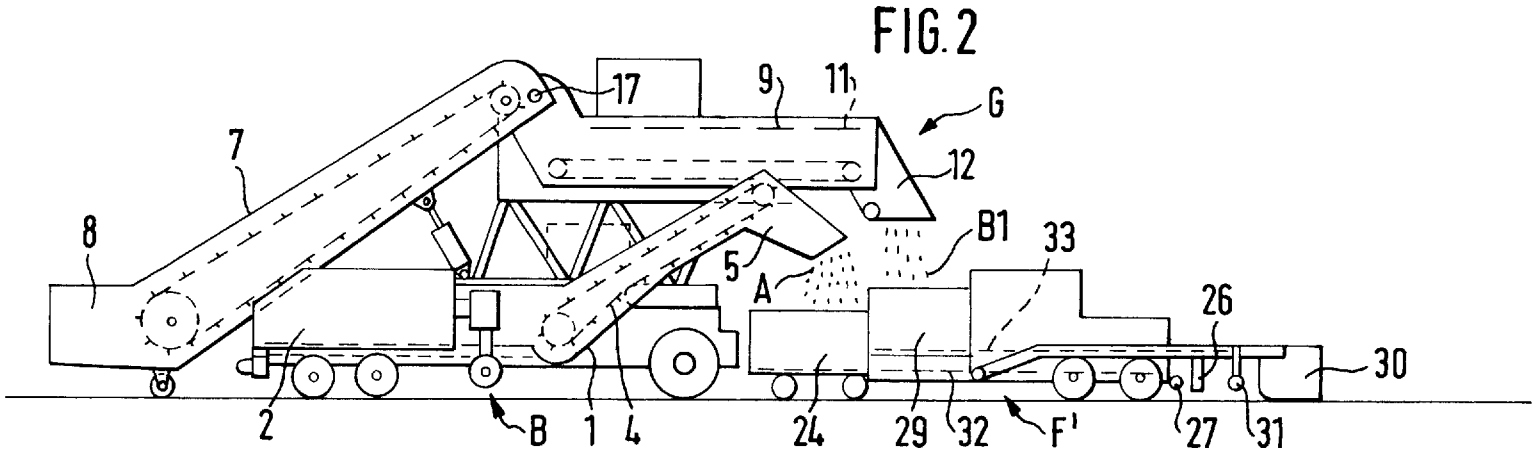
FIG. 2 is a diagrammatic side view of a second embodiment of the apparatus.

The apparatus according to FIG. 2 is also designed for the two-layered placement of two pavement material grades A, B1. Feeder B is directly positioned in front of a single road finisher F' which apart from a front material hopper 24 has a second material hopper 29 further behind. Separate longitudinal conveying means 32 and 33, two spaced-apart transverse distributing devices 27, 31 and two paving screeds 26, 30 are provided in the road finisher F'. The feeder B is filled with the first pavement material grade A in bulk material hopper 2 and feeds material hopper 24. The second pavement material grade B1 is filled into the feeding trough 8 of the second longitudinal conveying and intermediate storage device 7, 10 and is filled either directly from the discharge device 12 into the material hopper 29 or by means of a belt conveyor or a slat conveyor 14, as in FIG. 1, which may be of a shorter structure.

As for feeder B which is shown in FIG. 2, the second longitudinal conveying and intermediate storage device 7, 10 (with or without belt conveyor or slat conveyor 14), either together with or without the superstructure 6, is a removable structural unit of feeder B which without such a structural unit can be used for feeding a road finisher which lays single layers in the conventional manner.

As shown, a primary drive unit 15*a* could also be housed within superstructure 6 or in substructure 1. Furthermore, it would be possible to dislocate the articulated axle 17 more forwardly and more downwardly and optionally into superstructure 6 to achieve a space-saving pivot region for the front section 7. The belt conveyor or slat conveyor 14 could be longitudinally adjustable.

I claim:

1. In an apparatus for laying road-surface layers composed of first and second grades of pavement materials, comprising a first-road finisher having at a front side thereof a material hopper for receiving the first grade of pavement material and a feeder located upstream with respect to a traveling working direction of said first road finisher, said feeder comprising a movable substructure, a bulk material hopper located on said substructure for receiving said first grade of pavement material and a first longitudinal conveying device extending from said bulk material hopper up to and over the material hopper of said first road finisher for feeding said first grade of pavement material to said material hopper, the improvement comprising a second road finisher having a material hopper for receiving the second grade of pavement material located behind the first road finisher, a superstructure on said feeder that extends above the bulk material hopper and the first longitudinal conveying device, a second longitudinal conveying and intermediate storage device on said superstructure of said feeder for feeding the second grade of pavement material to the material hopper of the second road finisher, the second longitudinal conveying and intermediate storage device extending up to and over the material hopper of the second road finisher, and a forward section of the second longitudinal conveying and intermediate storage device being adjustable on said feeder relative to the bulk material hopper between a position for receiving the second grade of pavement material and a passive position in which the bulk material hopper of said feeder is accessible for receiving the first grade of pavement material.

2. The apparatus of claim 1, wherein a portion of said second longitudinal conveying and intermediate storage device extends over the first road finisher located between said feeder and said second road finisher, and said apparatus includes support means arranged on said first road finisher for supporting said portion.

3. In an apparatus for laying road-surface layers composed of first and second grades of pavement materials, comprising a road finisher having at a front side thereof a first material hopper for receiving the first grade of pavement material and a feeder located upstream with respect to a traveling working direction of said road finisher, said feeder comprising a movable substructure, a bulk material hopper located on said substructure for receiving said first grade of pavement material and a first longitudinal conveying device extending from said bulk material hopper up to and over the material hopper of said road finisher for feeding said first grade of pavement material to said first material hopper, the improvement comprising a second material hopper on said road finisher for receiving the second grade of pavement material, a superstructure on said feeder that extends above the bulk material hopper and the first longitudinal conveying device, a second longitudinal conveying and intermediate storage device on said superstructure of said feeder for feeding the second grade of pavement material to the second material hopper of the road finisher, the second longitudinal conveying and intermediate storage device extending up to and over the second material hopper of the road finisher, and a forward section of the second longitudinal conveying and intermediate storage device being adjustable on said feeder relative to the bulk material hopper between a position for receiving the second grade of pavement material and a passive position in which the bulk material hopper of said feeder is accessible for receiving the first grade of pavement material.

4. In a feeder for feeding pavement material to a first material hopper of at least one road finisher comprising a self-propelled substructure having arranged at a front end thereof a bulk material hopper for receiving a first grade of pavement material and a first longitudinal conveying device extending rearwardly of said bulk material hopper for feeding the first grade of pavement material to said first material hopper, the improvement wherein said feeder has a superstructure extending above said bulk material hopper and said first longitudinal conveying device, a second longitudinal conveying and intermediate storage device on said superstructure for feeding a second grade of pavement material to a second material hopper located on said at least one road finisher or located on a second road finisher located rearwardly of said at least one road finisher, said second longitudinal conveying and intermediate storage device extending up to and over the second material hopper, and a forward section of said second longitudinal conveying and intermediate storage device being adjustably supported on said feeder relative to said bulk material hopper between a position for receiving the second grade of pavement material and a passive position in which said bulk material hopper of said feeder is accessible for receiving the first grade of pavement material.

5. The feeder of claim 4, wherein the forward section of the second longitudinal conveying and intermediate storage device is pivotally supported on said superstructure such that it can be pivoted upwards, and at least one drive means is provided between said forward section and said substructure or said superstructure of said feeder for pivoting said forward section.

6. The feeder of claim 4, wherein said forward section has a front feeding trough and pivotable ground running wheels.

7. The feeder of claim 4, wherein said second longitudinal conveying and intermediate storage device includes a first horizontal belt or slat conveyor mounted on said superstructure that follows said forward section.

8. The feeder of claim 7, wherein said belt or slat conveyor is upwardly covered and provided with a heating device.

9. The feeder of claim 7, wherein said second longitudinal conveying and intermediate storage device includes a further belt or a slat conveyor following said first horizontal belt or slat conveyor and is pivotally mounted with respect thereto so that it can be pivoted in an upwardly pivotable manner, said further conveyor having a throw-off shoot at a read end thereof.

10. The feeder of claim 7, including at least one drive means for driving said feeder located above said first conveyor and an operator's stand laterally next to said superstructure.

11. The feeder of claim 4, wherein a steerable carriage part is provided in a front portion of said substructure below said bulk material hopper, and a driven carriage part is provided in a rear portion of said substructure, and lowerable and steerable transporting and maneuvering wheels are provided on said substructure between said carriage parts.

12. The feeder of claim 4, wherein said superstructure and said second longitudinal conveying and intermediate storage device are a structural unit which can be removed from said substructure.

13. The feeder of claim 4, wherein said second longitudinal conveying and intermediate storage device is a structural unit which can be removed from said superstructure.

14. The feeder of claim 12 or 13 wherein the substructure of said feeder and said structural unit each have a drive unit.

* * * * *